United States Patent [19]

Mattarelli

[11] Patent Number: 4,744,166

[45] Date of Patent: May 17, 1988

[54] FIRING MECHANISM WITH INTEGRATED SAFETY DEVICE FOR FIREARMS

[75] Inventor: Ennio Mattarelli, Bologna, Italy

[73] Assignee: Dynamit Nobel AG, Troisdorf, Fed. Rep. of Germany

[21] Appl. No.: 938,015

[22] Filed: Dec. 4, 1986

[30] Foreign Application Priority Data

Dec. 10, 1985 [IT] Italy ..... 3638 A/85

[51] Int. Cl.[4] ..... F41C 19/00; F41C 17/00

[52] U.S. Cl. ..... 42/69.01; 42/41; 42/70.08

[58] Field of Search ..... 42/41, 70.08, 23, 66, 42/69.01, 69.02, 70.01, 70.08

[56] References Cited

U.S. PATENT DOCUMENTS

| | | | |
|---|---|---|---|
| 2,367,280 | 1/1945 | Hyde | 89/140 |
| 2,453,897 | 11/1948 | Eklund | 89/148 |
| 4,133,128 | 1/1979 | Brush | 42/70.01 |
| 4,555,861 | 12/1985 | Khoury | 42/70.08 X |

FOREIGN PATENT DOCUMENTS

| | | | |
|---|---|---|---|
| 765373 | 6/1934 | France | 42/41 |
| 788777 | 10/1935 | France | 42/41 |

*Primary Examiner*—Ted L. Parr

*Attorney, Agent, or Firm*—Antonelli, Terry & Wands

[57] ABSTRACT

A firing mechanism with safety device for firearms, especially sport and hunting rifles and shotguns, with at least one barrel and a firing pin associated therewith and operable by way of a striker member in that the member is movable into an uncocked position, under the influence of the force of a compressed spring, against the firing pin after a trigger lever locking the striker member in a cocked position has been placed into a release position, and with at least one trigger with an associated rocker arm. In order to secure the firearm against unintended firing of shots due to external impact effects, the striker member is fashioned as a slide and is displaceable in the longitudinal direction from a rearward cocked position into a forward uncocked position. The trigger lever has an angled, curved, or like configuration and is arranged at the striker member so that it extends in the longitudinal direction and is pivotable about an axial support in such a way that, in the cocked position, the rear end of the trigger lever is secured by the rocker arm and the front end of the trigger lever rests in the forward direction on a stop fixedly formed within the frame and locks the striker member in the cocked position; this locking action being releasable by freeing the rear end of the trigger lever by way of the trigger-operated rocker arm and pivoting the trigger lever in such a way that the support of its front end at the stop is eliminated.

6 Claims, 1 Drawing Sheet

FIRING MECHANISM WITH INTEGRATED SAFETY DEVICE FOR FIREARMS

This invention relates to a firing mechanism with an integrated safety device for firearms of the type having at least one barrel and a firing pin associated therewith and operable by way of a striker member arranged in a frame, the striker member being movable into an uncocked position, under the influence of the force of a pretensioned or preloaded spring, against the firing pin after a trigger lever, locking the striker member in a cocked position, has been placed into a release position, and with at least one trigger with an associated rocker arm.

In these firearms, especially guns exhibiting two super-imposed or juxtaposed barrels for the firing of two shots, or in simpler models exhibiting only one barrel for firing a shot, there is the danger in spite of usage by experienced marksmen that undesirable impacts will act on the firearm. Thus, it may happen, for example, that the firearm, for various reasons, slips out of the marksman's hand and, due to its weight, hits the ground especially hard. On account of this impact, it can happen, even if the safety against unintended firing of shots is engaged, that a shot is fired uncontrolledly in spite of the fact that the safety of the firearm is placed in the "on" position, leading to material damage, or also to injuries to persons located in the proximity of the firearm in the firing line.

This failure of the safety can be traced back to the design of the heretofore utilized safety devices, which will be explained with reference to a mechanism for firing a shot in a rifle or shotgun.

This mechanism, accommodated in the breakdown frame of the rifle, usually includes a so-called striker member associated with a correspondingly strong compression spring. Upon cocking of the rifle, the striker member is pivoted in the direction toward the rifle butt, i.e. rearwardly, until a trigger lever engages into a corresponding detent on the underside of the striker member and thereby locks the member in the cocked position. During this process, the aforementioned compression spring is compressed simultaneously. During firing, the rifleman operates the trigger of the rifle, the trigger displacing the trigger lever via a so-called rocker arm and thus releasing the striker member so that the member is swung, under the effect of the force of the compression spring, against the associated firing pin. The firing pin, in turn, acts on the primer element of the cartridge whereby the shot is triggered, i.e. fired.

With the trigger lever being locked in place, the movement of the striker member is actually blocked, but this does not hold true for the movement of the trigger lever so that here an improper movement of the trigger lever can occur due to the effect of external impacts on the rifle whereby then the striker member is released and an uncontrolled shot is triggered. The reason for this is that in this conventional safety mechanism the trigger lever proper cannot be equipped with an additional blocking means since such a blocking means would damage the firing mechanism upon a renewed cocking of the rifle. It is necessary for the avoidance of such damage to make the trigger lever liftable during cocking; this, however, would be precluded by the additional blocking means.

The invention is based on the object of fashioning a firing mechanism of the type discussed heretofore described so that the aforementioned drawbacks are avoided, i.e. so that it is ensured that the unintentional "firing or discharging" of shots is reliably precluded, completely independently of the direction of the unintentional impact forces acting on the firearm. Furthermore, it must be ensured that the firearm can also be cocked and locked in case the rocker arm is locked in place by a conventional safety device to be operated manually. This safety device is designed, for example, as a slide arranged on the topside of the frame and being convertible manually from a "safety" position into a "release" position.

This object has been attained in accordance with the present invention wherein the striker member is fashioned as a slide and is displaceable in the longitudinal direction from a rearward cocked position A into a forward uncocked position B; the trigger lever is fashioned to be angled, curved, or the like and is arranged at the striker member so that it extends in the longitudinal direction and is pivotable about an axle in such a way that, in the cocked position A, the rear end of the trigger lever is secured by the rocker arm and the front end of the trigger lever rests in the forward direction on a stop fixedly formed within the frame of the firearm and locks the striker member in the cocked position A, this locking action being releasable by freeing the rear end of the trigger lever by way of the trigger-operated rocker arm and pivoting the trigger lever in such a way that the support of its front end at the stop is eliminated. The striker member is, in this arrangement, guided in corresponding guides of the frame and is connected to the trigger lever which lever, on the one hand, is pivotable and, on the other hand, is provided with such a shape that its rear end interlocks with the rocker arm in a shape-mating way in the cocked position and the front end of the trigger lever can, in this position, rest on a stop of the frame. In this firing mechanism with integrated safety device, the trigger lever proper is thus advantageously also locked in place additionally. The release of the striker member takes place herein in such a way that first the conventionally provided "external" slide safety of the rocker arm is to be eliminated so that the arm can be shifted, while operating the trigger of the firearm, so that the shape-mating connection between the rear end of the trigger lever and the rocker arm is eliminated. During this process, the trigger lever is advantageously pivoted at the same time by the rocker arm movement so that its front end slides off from the locking stop and passes over into a "release" position whereupon the striker member, under the action of the force of the preloaded compression spring, can be shifted against the firing pin into its uncocked position. However, in place of the forcible pivoting motion of the trigger lever by means of the rocker arm, it is also possible to provide that the rocker arm merely releases the rear end of the trigger lever and then, under the action of the force of the compression spring, the front end of the trigger lever slides off the locking stop in such a way that the trigger lever, in turn, executes a pivoting motion and thus passes over into the "release" position.

The trigger lever can be located, for example, on the underside of the striker member which is designed as a slide; in such a case, corresponding recesses are to be provided in the frame. In a suitable embodiment of the invention, however, an arrangement, wherein the trigger lever is arranged on the topside of the striker member and projects with its rear end past the rearward end face of the striker member, is provided. In this arrangement, the rocker arm can engage, with a correspondingly integrally formed cam, for example, into the rear end of the trigger lever. However, with preference, a shape-mating connection between the trigger lever and the rocker arm is realized wherein the trigger lever, in the cocked position, engages with its rear end into a recess of the rocker arm.

An especially advantageous arrangement of the trigger lever is one wherein the trigger lever is arranged in a longitudinal groove of the striker member. This arrangement leads to a particularly compact and rugged construction. In this arrangement, the front end of the trigger lever extends to a greater or lesser extent past the topside of the striker member out of the groove so that this front end, in the cocked position, can rest perfectly on the stop formed in the frame. Then, for releasing the striker member, the trigger lever is pivoted so that its front end is entirely within the longitudinal groove, and accordingly the striker member can slide unhindered in the corresponding guide of the frame in the forward direction against the firing pin.

Upon the renewed cocking of the firearm, the trigger lever must execute an opposite pivotal motion as soon as, upon the rearward sliding of the striker member, the forward end of the trigger lever has reached and/or has passed the locking stop within the frame. For this purpose, the trigger lever can be provided, for example, with a corresponding torsion spring in the region of its pivot axis. However, an embodiment wherein a compression spring is associated with the front end of the trigger lever, this spring resting, on the one hand, thereon and, on the other hand, on the striker member, is preferred. The locking stop located in the frame has a surface of such a structure that, on the one hand, in the cocked position, the trigger lever can reliably rest thereon with its front end, but, on the other hand, for bringing about the release position of the trigger lever, the front end of the trigger lever can slide perfectly off this stop with a corresponding tilting motion of the lever. An arrangement wherein the stop is fashioned as a roller with an axis of rotation extending perpendicularly to the longitudinal direction of the firearm proves to be especially advantageous in this connection.

One embodiment of the invention is illustrated in the drawings and will be described in greater detail in the following description with reference to the drawings. The figures are, respectively, lateral views wherein.

Figure 1:
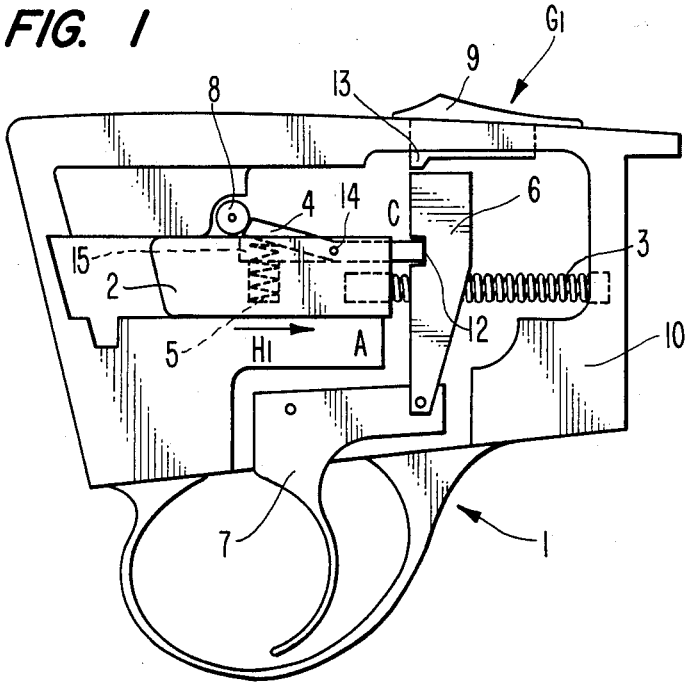
FIG. 1 shows the firing mechanism in the cocked position.

FIG. 1 shows the firing mechanism 1 of the invention arranged within a frame 10, in the cocked position A with the safety being in the "on" position. The frame 10 is accommodated in the interior of a breakdown frame, of, for example, a rifle, this breakdown frame not being shown in the figure. The striker member 2, fashioned as a slide with parallel surfaces, is shifted, by a downwardly tilting movement of the firearm barrel, not illustrated, during cocking in correspondence with arrow $H_1$ into the rearward, illustrated position A, during which step it is correspondingly guided in the frame 10. During this cocking movement, the coil spring 3 associated with the striker member 2 is simultaneously compressed.

A longitudinal groove 15 is worked into the topside of the striker member 2, the trigger lever 4 being arranged in this groove. The trigger lever 4 is designed as a slightly curved or slightly angled bar and is pivotable about a support 14 in the form of a pin, arranged in its center. The pin 14 is connected to the striker member 2. The length and the angling or, respectively, curvature of the trigger lever 4 are chosen so that this lever, in its "effective" position denoted by C, shown in FIG. 1, engages in a shape-mating connection with its rear end into the groove 12 of the rocker arm 6 and rests with its front end on the stop 8, here being designed as a roller rotatably fixed in the frame 10. In this arrangement, the front end of the trigger lever is urged out of the groove 15 past the topside of the striker member 2 under the action of the force exerted by the compression spring 5 arranged in the striker member 2. The roller 8 is located in contact with the topside of the striker member 2 or at a small spacing therefrom.

The rocker arm 6, operable by way of the trigger 7, is locked in place in the illustrated position by means of the "external" safety 9 here fashioned as a slide contacting, in the effective position $G_1$ shown, the rocker arm 6 by means of the cam 13 integrally formed at the slide.

Figure 2:
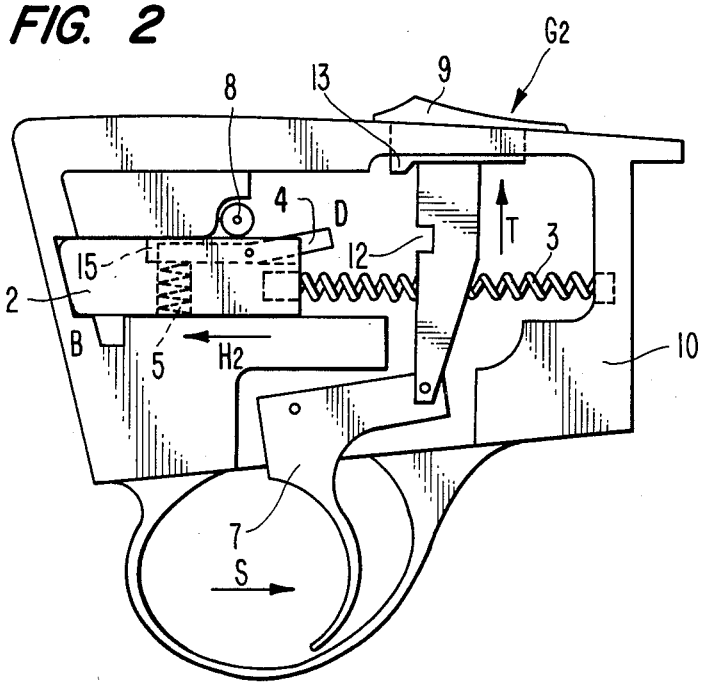
FIG. 2 shows the firing mechanism in the uncocked position.

For intentional firing of a shot, the slide 9—as illustrated in FIG. 2—is shifted forwards so that it assumes the illustrated position $G_2$ wherein the cam 13 no longer rests on the topside of the rocker arm 6. If then the trigger 7 is operated, in accordance with arrow S, the rocker arm is lifted in correspondence with arrow T. During this step, the rear end of the trigger lever 4 is perforce lifted so that it slides out of the groove 12 of the rocker arm 6 and assumes position D. At the same time, by this pivotal motion, the front end of the trigger lever 4 is lowered into the groove 15 with a corresponding revolving motion of the roller 8 whereby, in turn, the locking action on the striker member 2 is eliminated. The member 2 can then be moved, with relaxing of the coil spring 3, in correspondence with arrow $H_2$ into the uncocked position B, i.e. forwards against the firing pin, not shown, whereby the shot is triggered, i.e. a cartridge (not shown) is fired.

The trigger 7 is then returned in a manner shown per se by means of spring elements, not illustrated, into the starting position according to FIG. 1 and, correspondingly, the rocker arm 6 is also again returned into the position shown therein. Thereafter, the firearm can be cocked again and locked, by tilting the at least one barrel, i.e. the condition shown in FIG. 1 can be reestablished, optionally after previous actuation of the trigger safety 9, in other words by shifting the corresponding slide mounted to the frame 10 into the rearward, effective position $G_1$. In this condition, with the striker member 2 in position A and safety guide 9 in position $G_1$, the trigger lever 4 is completely blocked by the rocker arm 6. Thereby, any possible, unintentional jolts are reliably prevented from causing the firearm to go off. If the slide 9 is made to assume the forward, ineffective position $G_2$, the rocker arm 6 is released, and the firearm is once again ready for firing.

I claim:

1. A firing mechanism with a safety device for a firearm and operable by way of a striker member arranged in a frame, the striker member being movable into an uncocked position, under the influence of the force of a compression spring, after a trigger lever, locking the striker member in a cocked position, has been placed into a release position, and with at least one trigger with an associated rocker arm characterized in that the striker member is fashioned as a slide and is displaceable in a longitudinal direction of the the mechanism from a rearward cocked position to a forward uncocked position; the trigger lever is fashioned to be angled, curved, or the like non-linear configuration and is pivoted on a support located on the striker member so that a portion of the trigger lever extends in the longitudinal direction and the trigger lever is pivotable about the support in such a way that, in the cocked position, a rear end of the trigger lever is secured by the rocker arm and a front end of the trigger lever rests on a stop fixedly formed within the frame and locks the striker member in the cocked position, this locking action being releasable by freeing the rear end of the trigger lever by way of operation of the at least one trigger and associated rocker arm and pivoting the trigger lever in such a way that resting of the front end on the stop is eliminated.

2. A mechanism according to claim 1, characterized in that the trigger lever is arranged on a topside of the striker member and a rear end of the trigger lever extends past a rearward end face of the striker member.

3. A mechanism according to claim 1, characterized in that the trigger lever, in the cocked position, engages with a rear end thereof into a recess of the rocker arm.

4. A mechanism according to claim 1, characterized in that the trigger lever is arranged in a longitudinal groove of the striker member.

5. A mechanism according to claim 1, characterized in that a compression spring is associated with the front end of the trigger lever, the spring resting, on the one hand, thereon and, on the other hand, on the striker member.

6. A mechanism according to claim 1, characterized in that the stop is fashioned as a roller with an axis of rotation extending perpendicularly to the longitudinal direction of the mechanism.

* * * * *